US007905182B2

(12) United States Patent
Janik et al.

(10) Patent No.: US 7,905,182 B2
(45) Date of Patent: Mar. 15, 2011

(54) MULTI-MODE MODULAR PROJECTILE

(75) Inventors: Richard Janik, Tucson, AZ (US); Richard Dryer, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 479 days.

(21) Appl. No.: 11/143,336

(22) Filed: Jun. 2, 2005

(65) Prior Publication Data

US 2006/0272538 A1 Dec. 7, 2006

(51) Int. Cl.
*F42B 12/00* (2006.01)

(52) U.S. Cl. ..... 102/517; 102/377; 102/293; 102/473

(58) Field of Classification Search ..... 102/430, 102/446, 516, 517, 293, 473, 518–528
See application file for complete search history.

(56) References Cited

U.S. PATENT DOCUMENTS

| | | | | | |
|---|---|---|---|---|---|
| 3,141,246 | A * | 7/1964 | Boris | 434/24 |
| 4,051,414 | A * | 9/1977 | Will et al. | 361/802 |
| 4,211,168 | A * | 7/1980 | Haep | 102/444 |
| 5,103,734 | A * | 4/1992 | Arnaud et al. | 102/489 |
| 5,333,551 | A * | 8/1994 | Heitmann et al. | 102/439 |
| 5,400,715 | A * | 3/1995 | Roach et al. | 102/443 |
| 6,109,185 | A * | 8/2000 | Mikhail | 102/476 |
| 6,227,096 | B1 * | 5/2001 | Thomas | 89/1.54 |
| 6,378,437 | B1 * | 4/2002 | Burke et al. | 102/293 |
| 6,494,140 | B1 * | 12/2002 | Webster | 102/374 |
| 6,568,330 | B1 * | 5/2003 | Kaiserman et al. | 102/374 |
| 6,796,242 | B2 * | 9/2004 | Shi | 102/378 |
| 6,834,592 | B2 * | 12/2004 | Koger | 102/439 |
| 7,059,249 | B2 * | 6/2006 | Chaboki et al. | 102/202.8 |
| 7,237,489 | B2 * | 7/2007 | Naderhoff et al. | 102/498 |
| 2003/0051626 | A1 * | 3/2003 | Koger | 102/473 |
| 2003/0097951 | A1 * | 5/2003 | Kaiserman et al. | 102/374 |
| 2004/0020395 | A1 * | 2/2004 | Kutzli et al. | 102/223 |
| 2005/0066849 | A1 * | 3/2005 | Kapeles et al. | 102/517 |

* cited by examiner

*Primary Examiner* — Benjamin P Lee
(74) *Attorney, Agent, or Firm* — The Noblitt Group, PLLC

(57) ABSTRACT

The disclosed system, device and method for providing a multi-mode munition generally includes a modular projectile assembly having an aft module suitably configured for mechanical and electrical engagement with a forward module. The aft module generally provides a common assembly for engagement with a variety of forward modules as well as engagement with cartridge casings of various calibers. Disclosed features and specifications may be suitably controlled, adapted or otherwise optionally modified to improve optimization of artillery projectiles for a specific role. Exemplary embodiments of the present invention generally provide munition cartridges that may be augmented in the field with the utilization of specialized forward modules.

16 Claims, 6 Drawing Sheets

MULTI-MODE MODULAR PROJECTILE

FIELD OF INVENTION

The present invention generally provides for modular customization of artillery projectiles; and more particularly, representative and exemplary embodiments of the present invention generally relate to systems and methods for providing common aft assemblies for munition rounds which may be augmented with specialized forward modules.

BACKGROUND OF INVENTION

Previous attempts to design a munition cartridge to meet the requirements of the Medium Range Munition (MRM) specification produced unaffordable solutions. Some developers have proposed solutions which appear to meet the requirements, but constrain the user to select a specific caliber round (e.g., 120 mm). If the user selects a 105 mm cannon, for example, existing solutions do not provide the desired lethality.

To date, conventional munition cartridges have not been proposed which allow the user to modify the cartridges for a specific mission in the field. Existing systems utilize either multi-purpose projectile cartridges, in which the system performance is compromised in order to satisfy diverse requirements, or single-purpose cartridges, which are sub-optimal against targets other than those they are designed to engage. What is needed is an entry-level, low-cost, modular approach to meeting the requirements of the MRM specification, in which the projectile may be optimized for its role.

SUMMARY OF THE INVENTION

In various representative aspects, the present invention provides a modular multi-mode projectile munition. Exemplary features generally include an aft module suitably configured for mechanical and electrical engagement with a forward module. The aft module provides a common assembly for engagement with a variety of specialized forward modules as well as engagement with cartridge casings of various calibers.

Advantages of the present invention will be set forth in the Detailed Description that follows and may be apparent from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the Detailed Description, wherein:

Figure 1:
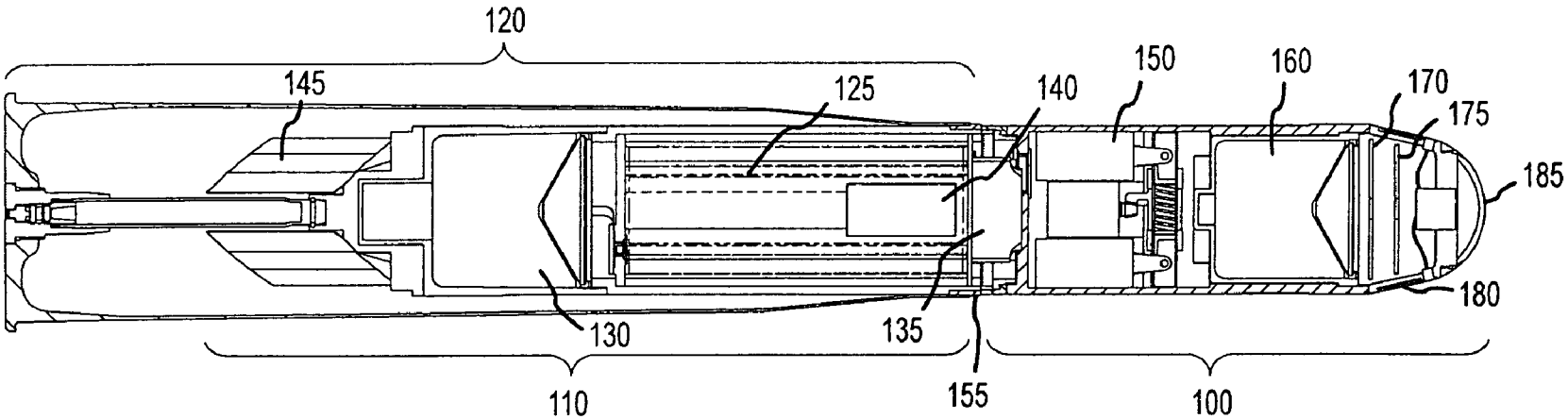
FIG. 1 representatively illustrates a side, cross-sectional view of a 105 mm munition round in accordance with an exemplary embodiment of the present invention.

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", and the like in the Description and/or in the claims, if any, are generally employed for descriptive purposes and not necessarily for comprehensively describing exclusive relative position. Any of the preceding terms so used may be interchanged under appropriate circumstances such that various embodiments of the invention described herein may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Various representative implementations of the present invention may be applied to any system for the modular augmentation of munition rounds with specialized modules. Certain representative implementations may include optimization of artillery cartridges for a specific role, such as, for example: low-cost ballistic projectiles; autonomous anti-armor projectiles; all-weather autonomous projectiles; semi-active laser projectiles; multi-mode projectiles; and/or the like.

As used herein, the terms "munition", "artillery", "cartridge", "round" and/or any variation or combination thereof, are generally intended to include anything that may be regarded as at least being susceptible to characterization as, or generally referring to, a projectile suitably adapted for launch via a gun, a rail or a rocket motor, such as, for example: an artillery shell; a tank round; a rocket propelled grenade (RPG); a surface-to-air missile (SAM); and/or the like.

A detailed description of exemplary applications, namely modular 105 mm and 120 mm tank rounds, are provided as specific enabling disclosures that may be generalized to any application of the disclosed system, device and method for the modular augmentation of munition cartridges in accordance with various embodiments of the present invention.

Prior attempts to develop a single cartridge to meet the requirements of the medium range munition (MRM) specification resulted in substantially expensive systems. One of the principal drawbacks of these approaches has been the conceptual model employed that generally requires a comprehensive system solution in a unitary design. While unitary designs have been demonstrated, their fabrication and logistical support costs have proven to be excessive.

Various representative and exemplary embodiments of the present invention generally provide a modular approach to meeting the MRM specification requirements while providing an entry-level, low-cost alternative to unitary designs. It will be appreciated that additional features may be readily adapted, extended, or otherwise applied to future component module designs. Accordingly, it will be further understood that the present invention is more generally directed to the generic conceptual approach of augmenting a munition device in a modular fashion with the utilization of common aft module components rather than merely disclosing specific module designs and/or combinatorial permutations.

Representative and exemplary embodiments of the present invention provide a common aft module assembly for a projectile cartridge, which may be augmented in the field (e.g., depot level) with the attachment of specialized forward modules. Accordingly, the present invention provides a modular projectile device optimized for at least one of a plurality of specific engagement/deployment roles; for example: a low-cost ballistic projectile; an autonomous anti-armor projectile; an all-weather autonomous projectile; a semi-active laser projectile; a multi-mode projectile; and/or the like.

In general, conventional fixed tank ammunition may not be modified. A modular munition cartridge approach to fixed tank ammunition, for example, would provide several advantages. As representatively depicted in FIG. 1, for example, a 105 mm tank round in accordance with an exemplary embodiment of the present invention, generally comprises a common aft module 110 housed within a 105 mm munition casing 120. Common aft module 110 is suitably configured with a connective element for engagement with a substantially matching suitably configured connective element of forward module assembly 100. In the case of the representative example illustrated in FIG. 1, the aft module connective element and the forward module connective element may correspond to an assembly engagement joint 155. Engagement joint 155 may comprise at least one threaded receptacle and at least one threaded extrusion. The resulting engagement of a threaded extrusion with a threaded receptacle would thereby secure the forward module assembly 100 to the aft module assembly 110 (or vice versa). Other types of connective elements may include, for example: clips, press fittings, slots, pins, bolts, clasps, welds or eutectic joints, channels, locks, retaining elements, cams, ball locks, releasable engagement elements, adhesives and/or the like. As generally depicted, for example in FIG. 1, assembly engagement joint 155 may comprise a press fit retaining element for mechanically connecting forward module assembly 100 to aft module assembly 110.

Alternatively, conjunctively or sequentially, forward module connective element(s) and aft module connective element (s) may further comprise electrical connections for transmitting power and/or data between forward module assembly 100 and aft module assembly 110. This may be useful in the case of disposing a battery in the aft assembly 110 to power sensors and/or guidance electronics in the forward assembly 100. Additionally, sensor and/or guidance data (either pre- or post-processed) may be transmitted from, for example, the forward module 100 to the aft module 110 for subsequent processing and/or mechanical actuation of guidance components, such as, for example, fins 145, canards 150 and/or the like.

The aft module 110 is a "common" module inasmuch as aft module 110 may be provided in a variety of different caliber cartridge casings 120 and the aft module configuration is generally invariant with respect to any of the specialized forward modules 100 that may be modularly engaged therewith. Specifically, common aft module 110 generally would require no specialized adjustment or other configuration (other than perhaps minor electrical/data or ballistic mode selections) for modular engagement with a particular specialized forward module 100.

Figure 2:
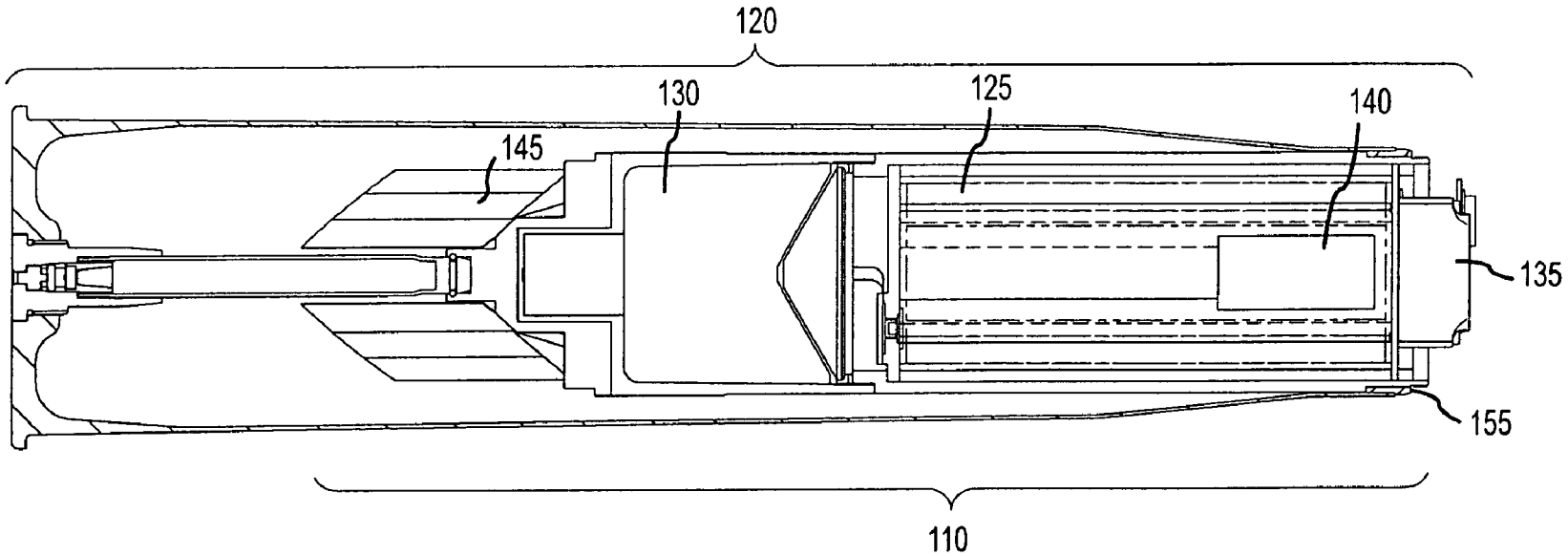
FIG. 2 representatively illustrates a side, cross-sectional view of a 105 mm munition round aft module in accordance with an exemplary embodiment of the present invention.

FIG. 2 generally depicts a representative common aft module in isolation from the composite modular munition cartridge generally illustrated in FIG. 1. Common aft module 110 may include, for example: cartridge casing 120 (e.g., 105 mm as generally depicted in FIG. 1), guidance electronics 125, a main explosive charge 130, an inertial measurement unit 135, a battery 140, fins 145, a propellant charge, a warhead, a sub-munition, other electronics, a primer, a fuze, a power interface, a data interface, an obturator, and/or the like. It will be appreciated that aft module 110 may be configured with a variety of additional or alternative components, whether now known or otherwise hereafter described in the art.

Cartridge casing 120 may comprise any type of material, such as, for example: cellulose, plastic, metal, paper, wax, and the like, including combinations thereof. Casing 120 may conform to a variety of different calibers, depending on the weapons platform selected for deploying the modular munition round. Cartridge casing 120 may further comprise a propellant material for accelerating or otherwise delivering a propulsive impulse to the modular munition cartridge upon deployment from a weapons platform.

Guidance electronics 125 may be configured for communication with a variety of munition sub-systems, including, for example: sensors, processors, multiplexers, discriminators, fin actuators, canard actuators, and the like. In a representative and exemplary embodiment, sensor and/or guidance data may be transmitted from forward module assembly 100 and/or inertial measurement unit 135 to guidance electronics 125 disposed in aft module assembly 110 for subsequent processing. Data and/or control signals may be relayed to actuate fins 145 and/or canards 150, thereby providing flight guidance.

Fins 145 may be stowed (FIG. 1 and FIG. 2) prior to firing the modular munition. Thereafter, fins 145 may deploy (FIG. 4 and FIG. 5) to provide sufficient stabilization and/or guidance of the modular munition during its flight to the target. It will be appreciated that a variety of fin configurations, mounting orientations and geometric designs may be employed to achieve a particular stabilization or flight performance requirement. The same shall be understood to be included within the scope of various embodiments of the present invention.

The aft-most component of a guided projectile, sometimes referred to as the "base", performs an important role in the success of a weapon system. The base provides an interface between the extreme pressures and shock loads resulting from the explosion of the propellant charge in the gun and the rest of the projectile. In addition, the base may support aerodynamic fins 145, which slow the rotation of the projectile as well as providing stabilization and lift. The fins 145 typically remain stowed during firing and deploy after the projectile exits the gun barrel and muzzle brake. The base may also support a projectile obturator, which is a device that seals the gap between the gun barrel bore and the projectile body. An obturator generally maximizes the efficiency of the propellant charge impulse forces, and also rotates relative to the projectile to reduce the spin rate imposed on the projectile by gun rifling.

In an exemplary embodiment, the base is designed to survive an extremely severe environment during launch. This includes high pressure, shock waves and extreme accelerations from the initial explosion of the propellant charge, as well as a muzzle exit event in which the projectile exits the gun barrel, which results in rapid depressurization. The gun used to launch the projectile may include a muzzle brake, which is cleared before the fins 145 deploy.

Figure 3:
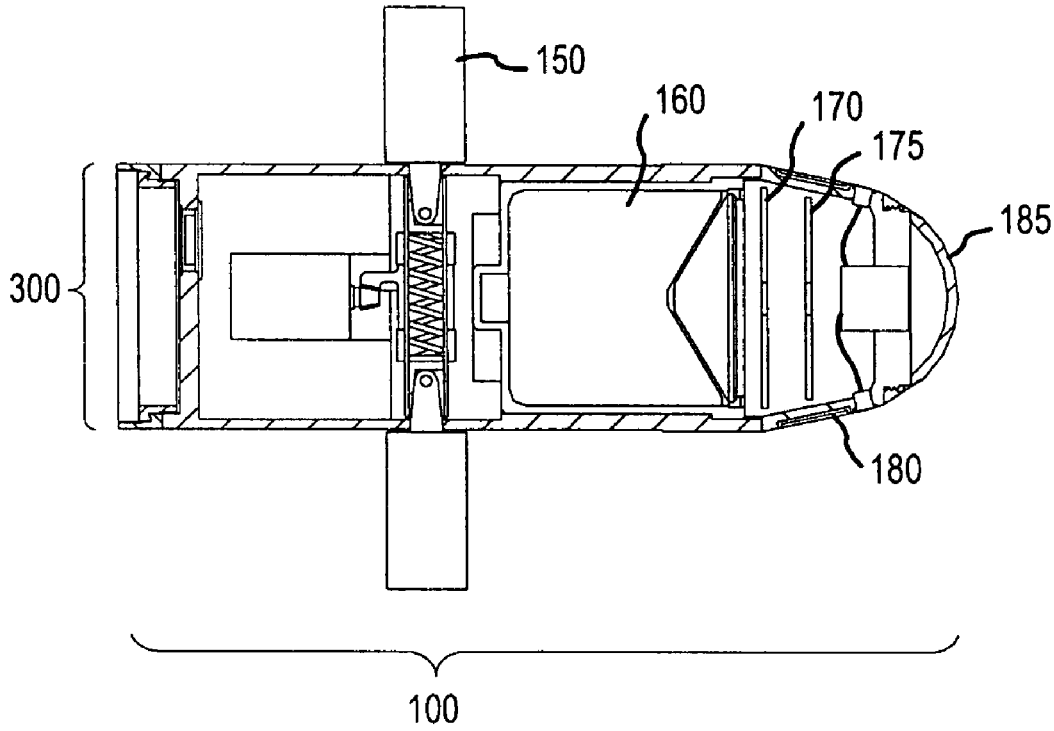
FIG. 3 representatively illustrates a side, cross-sectional view of a 105 mm munition round forward module in accordance with an exemplary embodiment of the present invention.
Figure 4:
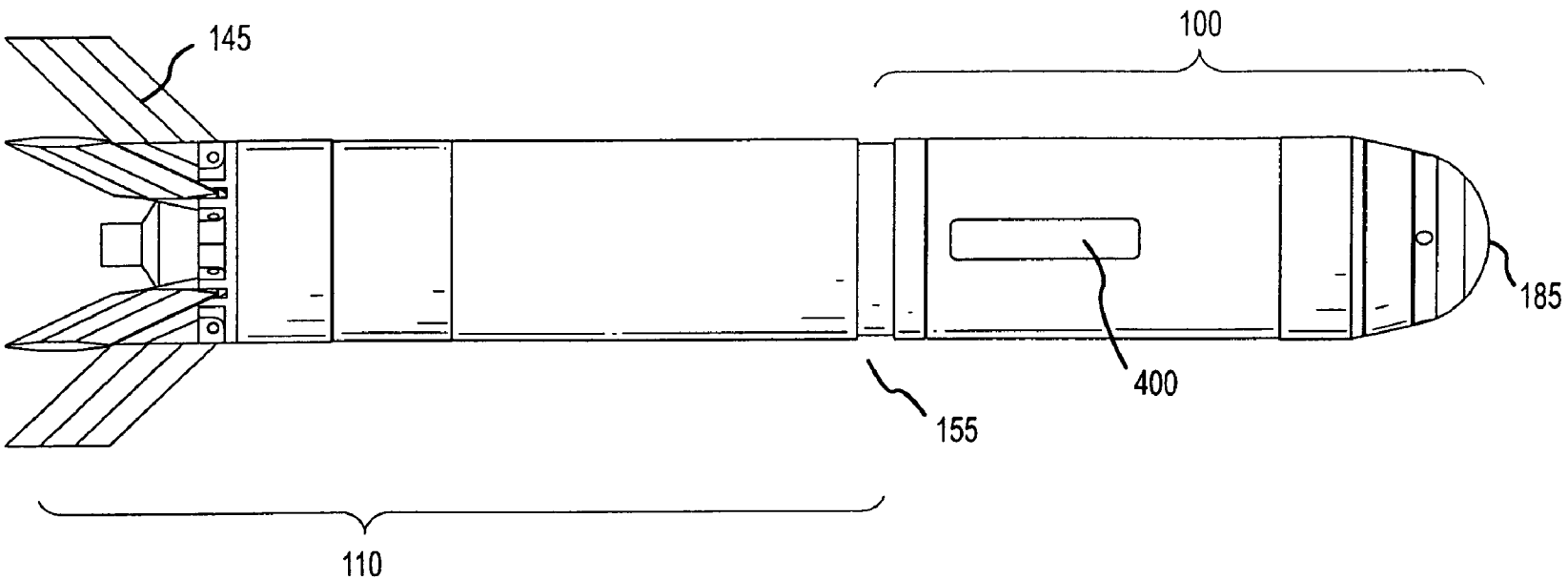
FIG. 4 representatively illustrates a side view of a deployed 105 mm munition round, in accordance with an exemplary embodiment of the present invention, with flight control fins in a deployed position and flight control canards in a stowed position.
Figure 5:
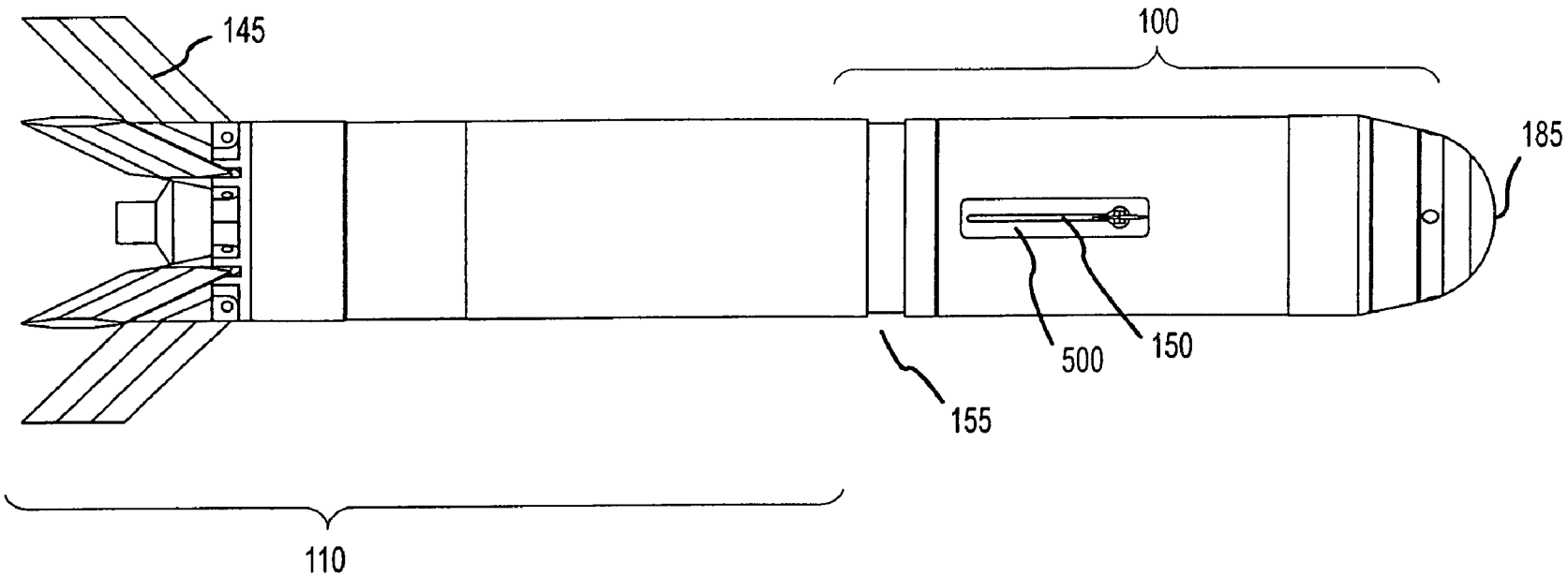
FIG. 5 representatively illustrates a side view of a deployed 105 mm munition round, in accordance with an exemplary embodiment of the present invention, with flight control fins and flight control canards in deployed positions.

FIG. 3 representatively depicts a specialized forward module 100 in isolation from the composite modular munition cartridge generally illustrated in FIG. 1. In FIG. 3, canards 150 are deployed to provide flight guidance. As generally shown in FIG. 4, forward module 100 may be configured with a protective casing element 400 which may be subsequently ejected or ruptured by the deployment of canards 150. After deployment (as shown from a side view in FIG. 5), canard 150 extends out from the casing of forward module 100 through opening 500. The view depicted in FIG. 3 generally corresponds to a top view of the forward module 100 portion of FIG. 5.

Specialized forward module 100 may include, for example: canards 150, a precursor warhead 160, a protective covering (e.g., radome 185), a sensor (e.g., MMW circuit card 175), an antenna (CAPS antenna 180), a fuze, counter-active measures (e.g., CAPS circuit card 170), an inertial measurement unit, guidance electronics, a sub-munition, other electronics, a primer, a fuze, a power interface, a data interface, a forward module engagement joint 300 (e.g., for engagement with aft assembly engagement joint at 155), and/or the like. It will be appreciated that forward module 100 may be configured with a variety of additional or alternative components, whether now known or otherwise hereafter described in the art.

In general, specialized forward mission modules are compatible with 105 mm and 120 mm tank ammunition aft modules. In the case of a 120 mm munition round, as representatively depicted in FIG. 6, for example, an adapter module 610 may be employed to size forward mission module 620 for engagement with a larger caliber aft module 600.

Aft module 600 is suitably configured with a connective element for engagement with a substantially matching suitably configured connective element of adapter module 610. In the case of the representative example illustrated in FIG. 6, the aft module connective element and the adapter module connective element may correspond to an aft assembly engagement joint 655. Engagement joint 655 may comprise, for example, at least one threaded receptacle and at least one threaded extrusion. The resulting engagement of threaded extrusion with threaded receptacle would thereby secure the adapter module assembly 610 to the aft module assembly 600 (or vice versa). Other types of connective elements may include, for example: clips, press fittings, slots, pins, bolts, clasps, welds or eutectic joints, channels, locks, retaining elements, cams, ball locks, releasable engagement elements, adhesives and/or the like. As generally depicted, for example in FIG. 6, assembly engagement joint 655 may comprise a press fit retaining element for mechanically connecting adapter module assembly 610 to aft module assembly 600.

Forward module 620 may be suitably configured with a connective element for engagement with a substantially matching suitably configured connective element of adapter module 610. In the case of the representative example illustrated in FIG. 6, the forward module connective element and the adapter module connective element may correspond to a forward assembly engagement joint 690. Engagement joint 690 may comprise, for example, at least one threaded receptacle and at least one threaded extrusion. The resulting engagement of threaded extrusion with threaded receptacle would thereby secure the adapter module assembly 610 to the forward module assembly 620 (or vice versa). Other types of connective elements may include, for example: clips, press fittings, slots, pins, bolts, clasps, welds or eutectic joints, channels, locks, retaining elements, cams, ball locks, releasable engagement elements, adhesives and/or the like. As generally depicted, for example in FIG. 6, forward assembly engagement joint 690 may comprise a press fit retaining element for mechanically connecting adapter module assembly 610 to forward module assembly 620.

Alternatively, conjunctively or sequentially, forward module connective element(s), adapter module connective element(s), and aft module connective element(s) may further comprise electrical connections for transmitting power and/or data between forward module assembly 620 and aft module assembly 600. This may be useful in the case of disposing a battery 640 in the aft assembly 600 to power sensors and/or guidance electronics in the forward assembly 620. Additionally, sensor and/or guidance data (either pre- or post-processed) may be transmitted from, for example, the forward module 620 to the aft module 600 (via connective elements provided in adapter module 610) for subsequent processing and/or mechanical actuation of guidance components, such as, for example, fins 645, canards 650 and/or the like.

Figure 6:
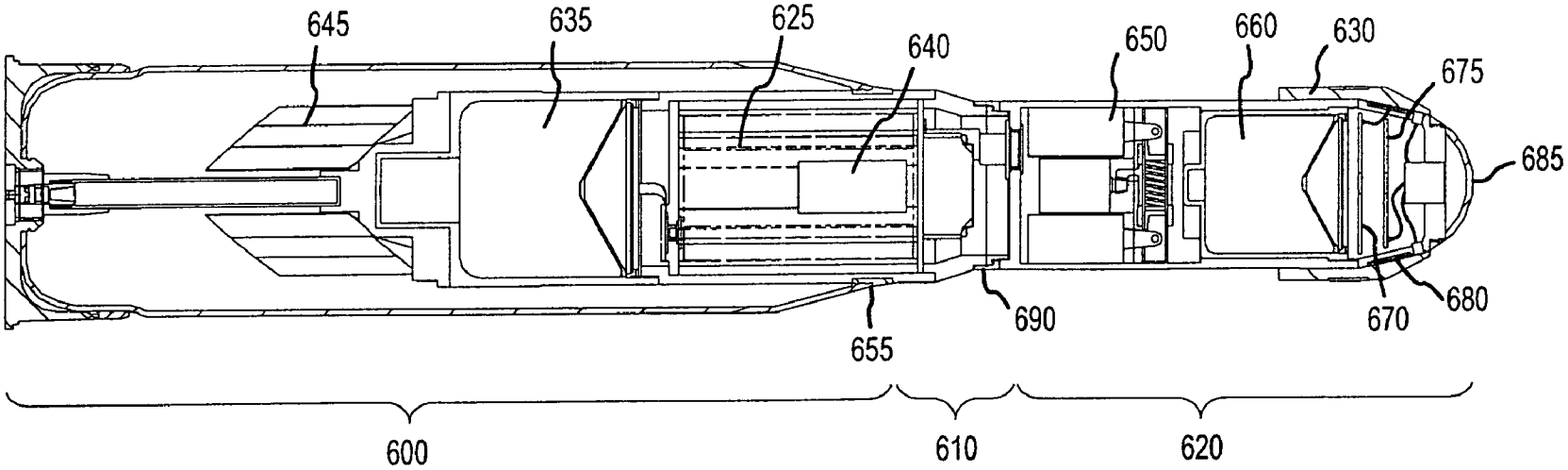
FIG. 6 representatively illustrates a side, cross-sectional view of a 120 mm munition round in accordance with an exemplary embodiment of the present invention.

Common aft module 600 may include, for example: a cartridge casing (e.g., 120 mm as generally depicted in FIG. 6), guidance electronics 625, a main explosive charge 635, an inertial measurement unit, a battery 640, fins 645, a propellant charge, a warhead, a sub-munition, other electronics, a primer, a fuze, a power interface, a data interface, an obturator, and/or the like. It will be appreciated that aft module 600 may be configured with a variety of additional or alternative components, whether now known or otherwise hereafter described in the art.

Guidance electronics 625 may be configured for communication with a variety of munition sub-systems, including, for example: sensors, processors, multiplexers, discriminators, fin actuators, canard actuators, and the like. In a representative and exemplary embodiment, sensor and/or guidance data may be transmitted from forward module assembly 620 and/or an inertial measurement unit to guidance electronics 625 disposed in aft module assembly 600 for subsequent processing. Data and/or control signals may be relayed to actuate fins 645 and/or canards 650, thereby providing flight guidance.

Fins 645 may be stowed prior to firing the modular munition. Thereafter, fins 645 may deploy to provide sufficient stabilization and/or guidance of the modular munition during its flight to the target. It will be appreciated that a variety of fin configurations, mounting orientations and geometric designs may be employed to achieve a particular stabilization or flight performance requirement. The same shall be understood to be included within the scope of various additional embodiments of the present invention.

Specialized forward module 620 may include, for example: canards 650, a precursor warhead 660, a protective covering (e.g., radome 685), a sensor (e.g., MMW circuit card 675), an antenna (CAPS antenna 680), a fuze, counter-active measures (e.g., CAPS circuit card 670), an inertial measurement unit, guidance electronics, a sub-munition, other electronics, a primer, a fuze, a power interface, a data interface, and/or the like. It will be appreciated that forward module 620 may be configured with a variety of additional or alternative components, whether now known or otherwise hereafter described in the art.

Resulting representative systems, in accordance with exemplary embodiments of the present invention, would reduced logistical burdens and costs, as well as allow users to deploy fewer rounds to theaters of operation. Users would also be afforded the tactical flexibility of being able to tune munitions to immediate threats. Munition platforms could be mixed-and-matched to better balance the considerations between low-cost competent munitions and high-technology autonomous munitions.

Modular components, in accordance with representative aspects of the present invention, may be assembled at several locations, including, for example: factories, state-side depots, ammo re-supply ships, forward depots, in the field, and the like. Various aspects of the present invention have corresponding complexity as compared with current artillery logistics. For example, projectiles, propellant charges and fuzes typically arrive separately at a weapon site with the projectile (and fuze) assembled and set at the weapon, as well as the propellant charge selected and adjusted at the weapon.

In the foregoing specification, the invention has been described with reference to specific exemplary embodiments; however, it will be appreciated that various modifications and changes may be made without departing from the scope of the present invention as set forth in the claims below. The specification and Figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. An aft module assembly for connecting to one of at least two different types of mission specific forward modules to form a ballistically fired projectile, comprising:

a common assembly module, comprising:

a guidance electronics unit adapted to:

communicatively interface with the at least two different types of mission specific forward modules;

control a first mission capability of the projectile when connected to a first type of mission specific forward module and control a second mission capability of the projectile when connected to a second type of mission specific forward module;

an explosive element;

a mechanical coupling element configured to selectively and interchangeably couple the common assembly module to the at least two different types of mission specific forward modules; and an electrical coupling element configured to selectively and interchangeably link the guidance electronics unit to the at least two different types of mission specific forward modules; and a munition cartridge casing coupled to and enclosing at least a portion of the common assembly module, wherein the cartridge casing is configured to decouple from the common assembly module substantially concurrently with a firing of the projectile.

2. An aft module assembly according to claim 1, wherein the common assembly module and the mission specific forward modules comprise substantially equal caliber sizes.

3. An aft module assembly according to claim 1, wherein the munition cartridge casing comprises a larger caliber than the common assembly module and the mission specific forward modules.

4. An aft module assembly according to claim 1, wherein the munition cartridge casing and the common assembly module comprise a larger caliber than the at least two different types of mission specific forward modules.

5. An aft module assembly according to claim 4, further comprising an adapter module coupled between the common assembly module and the connected mission specific forward module, wherein the adapter module forms a tapered transition between an exterior surface of the larger caliber common assembly module and an exterior surface of the connected mission specific forward module.

6. An aft module assembly according to claim 1, wherein the common assembly further comprises at least one of a fuze, an inertial measurement unit, a power interface, a data interface, and an obturator.

7. An aft module assembly according to claim 1, further comprising a propellant charge disposed in a volume defined by an inner surface of the munition cartridge casing and the common assembly module.

8. A method of allowing a user to modularly adapt a munition cartridge, comprising:

selecting a forward module from at least two different types of specialized forward modules in accordance with a mission specification provided by the user, wherein each of the at least two different types of specialized forward modules comprises:

a first mechanical coupling element; and a first electrical connector; and coupling the selected forward module to an aft assembly comprising:

a common aft module, wherein the common aft module comprises:

a guidance electronics unit adapted to:

interface with each of the at least two different types of specialized forward modules; and control a first mission capability of the munition cartridge when connected to a first type of mission specific forward module; and control a second mission capability of the munition cartridge when connected to a second type of mission specific forward module;

a second mechanical coupling element configured to couple to the first mechanical coupling element; and a second electrical connector configured to couple to the first electrical connector to transmit a signal between the guidance electronics unit and the selected forward module; and a munition cartridge casing coupled to and enclosing at least a portion of the common aft module, wherein the cartridge casing is decoupled from the common aft module substantially concurrently with a firing of the munition cartridge.

9. A method of allowing a user to modularly adapting a munition cartridge according to claim 8, further comprising coupling an adapter module between the first and second mechanical coupling elements and the first and second electrical connectors, wherein the adapter module allows the selected forward module to be mechanically and electrically coupled to the aft assembly, wherein:

the aft assembly is a larger caliber than the selected forward module; and the adapter module forms a tapered transition between an exterior surface of the larger caliber aft assembly and an exterior surface of the selected forward module.

10. A modular munition cartridge, comprising:

a forward module comprising a forward assembly selected from a plurality of different types of forward assemblies, wherein the each of the plurality of different types of forward assemblies comprises:

a first mechanical coupling element; and a first electrical connector; and an aft module coupled to the forward module, comprising:

a common assembly module, comprising:

a guidance electronics unit adapted to:

communicatively and interchangeably interface with the plurality of different types of forward assemblies; and control a first mission capability of the munition cartridge when connected to a first type of mission specific forward module; and control a second mission capability of the munition cartridge when connected to a second type of mission specific forward module;

an explosive element;

a second mechanical coupling element to mechanically couple the common assembly module to the first mechanical coupling element; and a second electrical connector configured to link the guidance electronics unit to the first electrical connector; and a munition cartridge casing coupled to and enclosing at least a portion of the common assembly module, wherein the cartridge casing is configured to decouple from the common assembly module substantially concurrently with a firing of the modular munition cartridge.

11. A modular munition cartridge according to claim 10, wherein the common assembly module and the forward module comprise substantially equal caliber sizes.

12. A modular munition cartridge according to claim 10, wherein the munition cartridge casing comprises a larger caliber than the common assembly module and the forward module.

13. A modular munition cartridge according to claim 10, wherein the munition cartridge casing and the common assembly module comprise a larger caliber than the forward module.

14. A modular munition cartridge according to claim 13, further comprising an adapter module coupled between the common assembly module and the forward module, wherein the adapter module forms a tapered transition between an exterior surface of the larger caliber common assembly and an exterior surface of the forward module.

15. A modular munition cartridge according to claim 10, wherein the common assembly further comprises at least one of a fuze, an inertial measurement unit, a power interface, a data interface, and an obturator.

16. A modular munition cartridge according to claim 10, wherein the aft module further comprises a propellant charge disposed in a volume defined by an inner surface of the munition cartridge casing and the common assembly module.

* * * * *